US010138735B2

(12) United States Patent
Benson et al.

(10) Patent No.: US 10,138,735 B2
(45) Date of Patent: Nov. 27, 2018

(54) TURBINE AIRFOIL INTERNAL CORE PROFILE

(71) Applicant: General Electric Company, Schenectady, NY (US)

(72) Inventors: Adebukola Oluwaseun Benson, Simpsonville, SC (US); Xiuzhang James Zhang, Simpsonville, SC (US); Nicholas Alvin Hogberg, Greenville, SC (US); Kenneth Earl Williams, Simpsonville, SC (US)

(73) Assignee: GENERAL ELECTRIC COMPANY, Schenectday, NY (US)

( * ) Notice: Subject to any disclaimer, the term of this patent is extended or adjusted under 35 U.S.C. 154(b) by 498 days.

(21) Appl. No.: 14/932,104

(22) Filed: Nov. 4, 2015

(65) Prior Publication Data

US 2017/0122111 A1 May 4, 2017

(51) Int. Cl.
*F01D 5/18* (2006.01)
*F01D 5/14* (2006.01)

(52) U.S. Cl.
CPC ..... *F01D 5/188* (2013.01); *F01D 5/147* (2013.01); *F05D 2260/201* (2013.01)

(58) Field of Classification Search
CPC ..... F01D 5/188; F01D 5/147
See application file for complete search history.

(56) References Cited

U.S. PATENT DOCUMENTS 2,866,618 A * 12/1958 Jackson ..... F01D 5/188 416/90 R
3,369,792 A * 2/1968 Kriaimer et al. ..... F01D 5/188 415/115
4,168,938 A * 9/1979 Dodd ..... F01D 5/188 415/115
4,314,795 A * 2/1982 Dadone ..... B64C 27/463 244/35 R
6,491,496 B2 12/2002 Starkweather
6,722,851 B1 4/2004 Brittingham et al.
6,893,210 B2 5/2005 Zhang et al.
6,966,756 B2 11/2005 McGrath et al.
7,070,392 B2 * 7/2006 Bradbury et al. .... F04D 29/384 416/243

(Continued)

FOREIGN PATENT DOCUMENTS

DE 10 07 565 B 5/1957
EP 1 473 440 A3 9/2007
GB 2 051 964 A 1/1981

OTHER PUBLICATIONS

Extended European Search Report and Opinion issued in connection with corresponding EP Application No. 16195547.1 dated Mar. 15, 2017.

*Primary Examiner* — Kevin Lee
(74) *Attorney, Agent, or Firm* — Dority & Manning, PA

(57) ABSTRACT

In one aspect of the present disclosure, an airfoil for a rotor blade of a gas turbine includes a normalized pressure side wall portion thickness, a normalized suction side wall portion thickness, a normalized leading edge wall thickness, and a normalized trailing edge wall thickness. The values of theses thicknesses define the pressure side wall portion thickness, the suction side wall portion thickness, the leading edge wall thickness, and the trailing edge wall thickness, which improve heat transfer, flow distribution, and mechanical load transfer.

20 Claims, 4 Drawing Sheets

(56) References Cited

U.S. PATENT DOCUMENTS

| | | | |
|---|---|---|---|
| 7,270,515 | B2 | 9/2007 | Liang |
| 7,416,391 | B2 | 8/2008 | Veltre et al. |
| 9,115,597 | B2 | 8/2015 | Spangler et al. |
| 2015/0152734 | A1 | 6/2015 | Ceglio et al. |
| 2017/0204730 | A1 | 7/2017 | Benson et al. |
| 2017/0234142 | A1 | 8/2017 | Benson et al. |

* cited by examiner

TURBINE AIRFOIL INTERNAL CORE PROFILE

FIELD OF THE INVENTION

The present invention generally relates to a rotor blade for a gas turbine. More particularly, this invention relates to a wall thickness profile for an airfoil portion of a rotor blade.

BACKGROUND OF THE INVENTION

A gas turbine generally includes a compressor section, a combustion section, a turbine section, and an exhaust section. The compressor section progressively increases the pressure of a working fluid entering the gas turbine and supplies this compressed working fluid to the combustion section. The compressed working fluid and a fuel (e.g., natural gas) mix within the combustion section and burn in a combustion chamber to generate high pressure and high temperature combustion gases. The combustion gases flow from the combustion section into the turbine section where they expand to produce work. For example, expansion of the combustion gases in the turbine section may rotate a shaft connected, e.g., to a generator to produce electricity. The combustion gases then exit the gas turbine via the exhaust section.

The turbine section includes a plurality of turbine rotor blades, which extract kinetic energy from the combustion gases flowing therethrough. These rotor blades generally operate in extremely high temperature environments. In order to achieve adequate service life, the rotor blades typically include an internal cooling cavity or envelope. The internal cooling cavity may include a plurality of cooling passages arranged in a serpentine-like manner. During operation of the gas turbine, a cooling medium such as compressed air is routed through the internal cooling cavity and/or cooling passages to cool the rotor blade.

The thickness of the rotor blade walls (i.e., the distance between the outer surface of the rotor blade and the inner surface of the rotor blade defining internal cooling cavity) is crucial for heat transfer, flow distribution, and mechanical load transfer. Accordingly, a rotor blade having a wall thickness distribution to better facilitate heat transfer, flow distribution, and mechanical load transfer would be useful in the art.

BRIEF DESCRIPTION OF THE INVENTION

Aspects and advantages of the invention are set forth below in the following description, or may be obvious from the description, or may be learned through practice of the invention.

In one aspect, the present disclosure is directed to an airfoil for a turbine blade. The airfoil includes a pressure side wall having a normalized pressure side wall thickness and a suction side wall having a normalized suction side wall thickness. The suction side wall connects to the pressure side wall at a leading edge and a trailing edge. The leading edge has a normalized leading edge thickness, and the trailing edge has a normalized trailing edge thickness. An internal cavity is defined by the pressure side wall and the suction side wall. The airfoil defines a span extending from zero percent of the span at an airfoil root and one hundred percent of span at an airfoil tip. The normalized pressure side wall thickness is between 0.194 and 0.214 at zero percent of the span, between 0.107 and 0.127 at fifty percent of the span, and between 0.080 and 0.100 at one hundred percent of the span. The normalized suction side wall thickness is between 0.202 and 0.222 at zero percent of the span, between 0.102 and 0.122 at fifty percent of the span, and between 0.089 and 0.109 at one hundred percent of the span. The normalized leading edge thickness is between 0.212 and 0.232 at zero percent of the span, between 0.108 and 0.128 at fifty percent of the span, and between 0.086 and 0.106 at one hundred percent of the span. The normalized trailing edge thickness is between 0.856 and 0.876 at zero percent of the span, between 0.900 and 1.100 at fifty percent of the span, and between 0.998 and 1.018 at one hundred percent of the span.

Another aspect of the present disclosure is directed to a gas turbine. The gas turbine includes a compressor section, a combustion section, and a turbine section. The turbine section includes a plurality of turbine blades, and each of the plurality of turbine blades includes an airfoil. The airfoil includes a pressure side wall having a normalized pressure side wall thickness and a suction side wall having a normalized suction side wall thickness. The suction side wall connects to the pressure side wall at a leading edge and a trailing edge. The leading edge has a normalized leading edge thickness, and the trailing edge has a normalized trailing edge thickness. An internal cavity is defined by the pressure side wall and the suction side wall. The airfoil defines a span extending between zero percent of the span at an airfoil root and one hundred percent of span at an airfoil tip. The normalized pressure side wall thickness is between 0.194 and 0.214 at zero percent of the span, between 0.107 and 0.127 at fifty percent of the span, and between 0.080 and 0.100 at one hundred percent of the span. The normalized suction side wall thickness is between 0.202 and 0.222 at zero percent of the span, between 0.102 and 0.122 at fifty percent of the span, and between 0.089 and 0.109 at one hundred percent of the span. The normalized leading edge thickness is between 0.212 and 0.232 at zero percent of the span, between 0.108 and 0.128 at fifty percent of the span, and between 0.086 and 0.106 at one hundred percent of the span. The normalized trailing edge thickness is between 0.856 and 0.876 at zero percent of the span, between 0.900 and 1.100 at fifty percent of the span, and between 0.998 and 1.018 at one hundred percent of the span.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
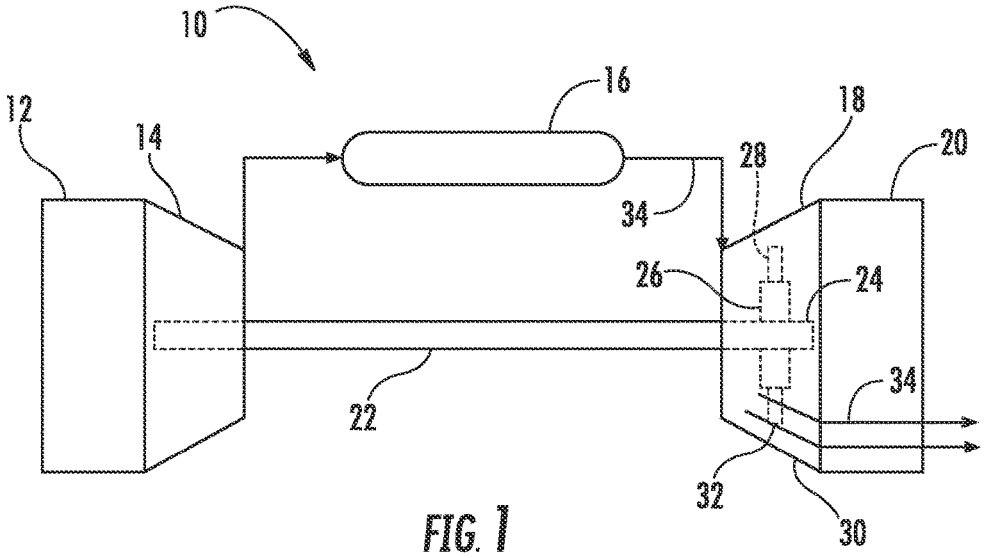
FIG. 1 is a schematic view of an exemplary gas turbine in accordance with the embodiments disclosed herein.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents. Although an industrial or land-based gas turbine is shown and described herein, the present invention as shown and described herein is not limited to a land-based and/or industrial gas turbine unless otherwise specified in the claims. For example, the invention as described herein may be used in any type of turbine including but not limited to a steam turbine or marine gas turbine.

Now referring to the drawings, wherein identical numerals indicate the same elements throughout the figures, FIG. 1 schematically illustrates a gas turbine system 10. It should be understood that the turbine system 10 of the present disclosure need not be a gas turbine system 10, but rather may be any suitable turbine system, such as a steam turbine system or other suitable system. The gas turbine system 10 may include an inlet section 12, a compressor section 14, a combustion section 16, a turbine section 18, and an exhaust section 20. The compressor section 12 and turbine section 18 may be coupled by a shaft 22. The shaft 22 may be a single shaft or a plurality of shaft segments coupled together to form shaft 22.

The turbine section 18 may generally include a rotor shaft 24 having a plurality of rotor disks 26 (one of which is shown) and a plurality of rotor blades 28 extending radially outwardly from and being interconnected to the rotor disk 26. Each rotor disk 26 in turn, may be coupled to a portion of the rotor shaft 24 that extends through the turbine section 18. The turbine section 18 further includes an outer casing 30 that circumferentially surrounds the rotor shaft 24 and the rotor blades 28, thereby at least partially defining a hot gas path 32 through the turbine section 18.

During operation, a working fluid such as air flows through the inlet section 12 and into the compressor section 14, where the air is progressively compressed to provide pressurized air to the combustors (not shown) in the combustion section 16. The pressurized air is mixed with fuel and burned within each combustor to produce combustion gases 34. The combustion gases 34 flow through the hot gas path 32 from the combustor section 16 into the turbine section 18, wherein energy (kinetic and/or thermal) is transferred from the combustion gases 34 to the rotor blades 28, thus causing the rotor shaft 24 to rotate. The mechanical rotational energy may then be used to power the compressor section 14 and/or to generate electricity. The combustion gases 34 exiting the turbine section 18 may then be exhausted from the gas turbine 10 via the exhaust section 20.

Figure 2:
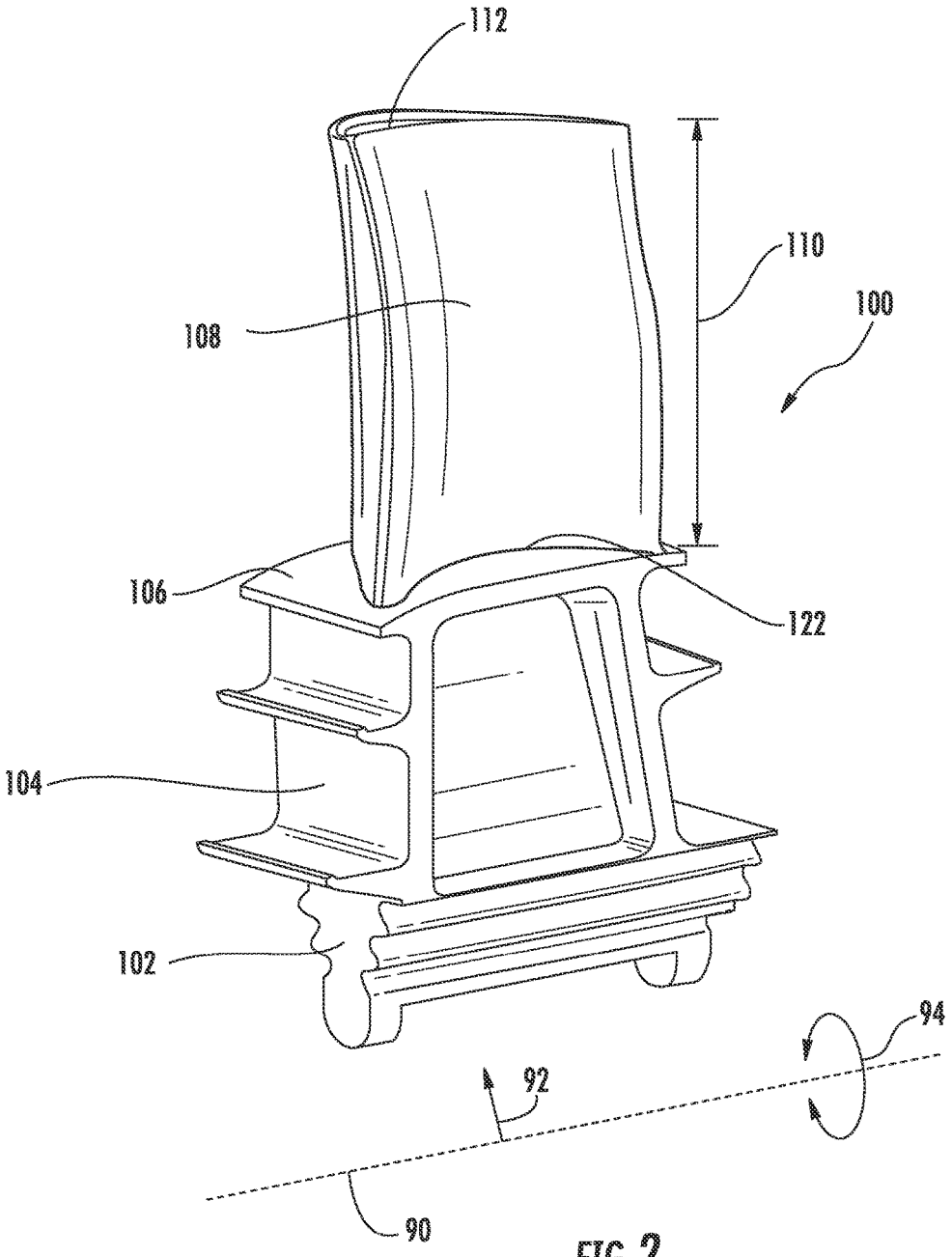
FIG. 2 is a perspective view of an exemplary rotor blade that may be incorporated in the gas turbine shown in FIG. 1 in accordance with the embodiments disclosed herein.
Figure 3:
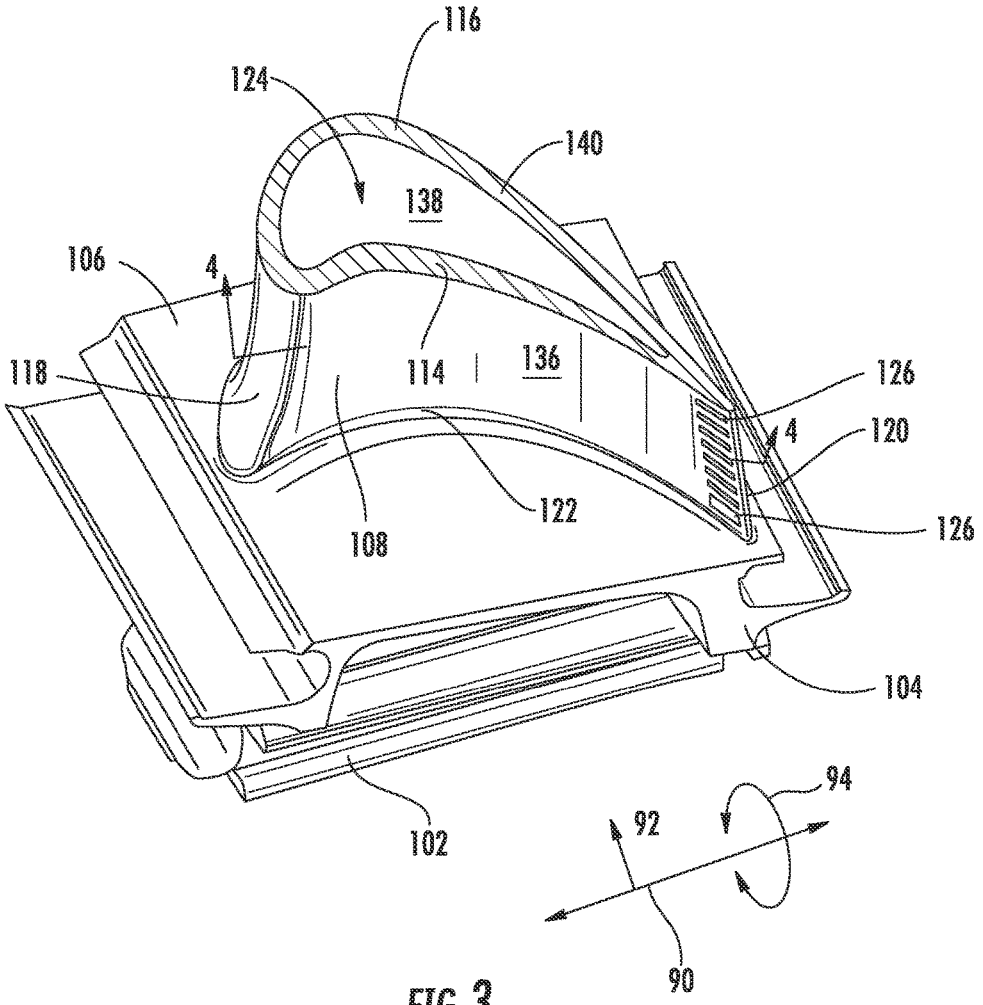
FIG. 3 is an alternate perspective view of the exemplary rotor blade shown in FIG. 2, illustrating an airfoil.

FIGS. 2 and 3 are perspective views of an exemplary rotor blade 100, which may incorporate one or more embodiments of the present invention and may be incorporated into the turbine section 18 of the gas turbine 10 in place of rotor blade 28 as shown in FIG. 1. As illustrated in FIGS. 2 and 3, the rotor blade 100 defines axial direction 90, a radial direction 92, and a circumferential direction 94. The radial direction 92 extends generally orthogonal to the axial direction 90, and the circumferential direction 94 extends generally concentrically around the axial direction 90.

As shown in FIG. 2, the rotor blade 100 generally includes a mounting or shank portion 104. A connecting portion 102 may extend radially inward from the shank portion 104. In this respect, the connection portion 102 may interconnect or secure the rotor blade 100 to the rotor disk 26 (FIG. 1). In some embodiments, for example, the connection portion 102 may have a dovetail configuration. A platform 106, which generally serves as a radially inward flow boundary for the combustion gases 34 flowing through the hot gas path 32 of the turbine section 18 (FIG. 1), is positioned at the radially outer end of the shank portion 104.

The rotor blade 100 includes an airfoil 108 that extends radially outwardly from the platform 106 to an airfoil tip 112. As such, the airfoil tip 112 may generally define the radially outermost portion of the rotor blade 100. The airfoil 108 connects to the platform 106 at an airfoil root 122 (i.e., the intersection between the airfoil 108 and the platform 106). The airfoil 108 defines an airfoil span 110 extending between the airfoil root 122 and the airfoil tip 112. In this respect, the airfoil root 122 is positioned at zero percent of the airfoil span 110, and the airfoil tip 112 is positioned at one hundred percent of the airfoil span 110. Fifty percent of the airfoil span, for example, would be half way (i.e., fifty percent of the way) between the airfoil root 122 and the airfoil tip 112. Accordingly, a person having ordinary skill in the art would be able to calculate where along the radial length of the airfoil 108 various percentages of the airfoil span 110 are located.

FIG. 3 is an alternate perspective view of the rotor blade 100, illustrating the shape of the airfoil 108. The airfoil tip 112 has been removed for the purpose of illustration. The airfoil 108 includes an airfoil wall 140 having an outer surface 136 and inner surface 138. The airfoil wall 140 includes a pressure side wall portion 114 and an opposing suction side wall portion 116. The pressure side wall portion 114 and the suction side wall portion 116 are joined together or interconnected at a leading edge 118 of the airfoil 108, which is oriented into the flow of combustion gases 34. The pressure side wall portion 114 and the suction side wall portion 116 are also joined together or interconnected at a trailing edge 120 of the airfoil 108, which is spaced downstream from the leading edge 118. The pressure side wall portion 114 and the suction side wall portion 116 are continuous about the leading edge 118 and the trailing edge 120. The pressure side wall portion 114 is generally concave, and the suction side wall portion 116 is generally convex.

The inner surface 138 of the airfoil wall 140 defines an internal cavity 124 for cooling the airfoil 108. In this respect, a cooling medium (e.g., compressed air bled from the compressor section 14) may be channeled through the shank portion 104 of the rotor blade 100 and into the internal cavity 124. The internal cavity 124 may include serpentine passages (not shown) or simply be an open cavity illustrated in FIG. 3.

In some embodiments, the pressure side wall portion 114 and/or the suction side wall portion 116 of the airfoil 108 may define one or more cooling apertures 126 extending therethrough. The cooling apertures 126 may be positioned proximate to the trailing edge 120. The cooling apertures 126 permit cooling air to exit the internal cavity 124 and/or any of the serpentine passages therein.

Figure 4:
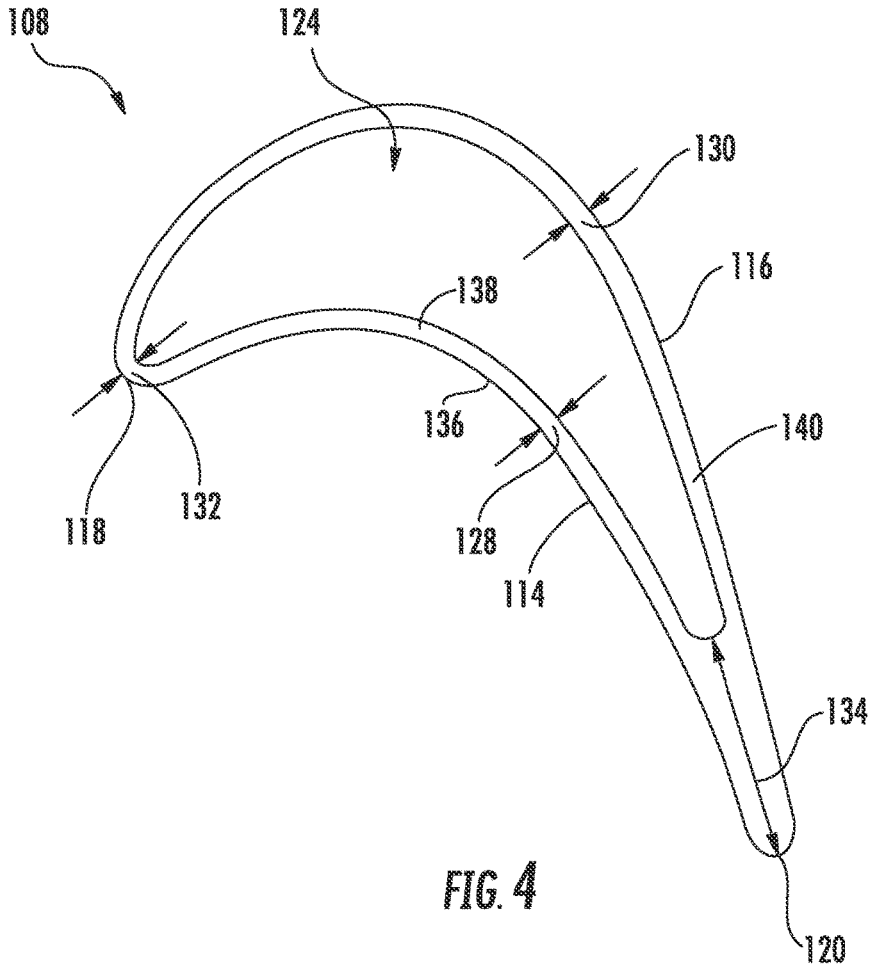
FIG. 4 is a cross-sectional view of the airfoil taken general about line 4-4 in FIG. 3, illustrating the geometry thereof.

FIG. 4 is a cross-sectional view of the airfoil 108, illustrating various thicknesses thereof. More specifically, the airfoil 108 includes a pressure side wall portion thickness 128, which is the distance between the outer surface 136 and the inner surface 138 of the pressure side wall portion 114 of airfoil wall 140. The airfoil 108 also includes a suction side wall portion thickness 130, which is the distance between the outer surface 136 and the inner surface 138 of the suction side wall portion 116 of airfoil wall 140. The airfoil 108 further includes a leading edge wall thickness 132, which is the distance between the outer surface 136 and the inner surface 138 of the leading edge 118 of airfoil wall 140. The airfoil 108 also includes a trailing edge wall thickness 134, which is the distance between the outer surface 136 and the inner surface 138 of the trailing edge 118 of airfoil wall 140.

In this respect, the pressure side wall portion thickness 128, the suction side wall portion thickness 130, the leading edge wall thickness 132, and the trailing edge wall thickness 134 along the airfoil span 110 define the shape and relative size of the internal cavity 124. As such, the pressure side wall portion thickness 128, the suction side wall portion thickness 130, the leading edge wall thickness 132, and the trailing edge wall thickness 134 may be different. Furthermore, each of the pressure side wall portion thickness 128, the suction side wall portion thickness 130, the leading edge wall thickness 132, and the trailing edge wall thickness 134 may vary along the airfoil span 110. For example, the pressure side wall portion thickness 128 may be different at twenty percent of the airfoil span 110 than at seventy percent of the airfoil span 110.

The values the pressure side wall portion thickness 128, the suction side wall portion thickness 130, the leading edge wall thickness 132, and the trailing edge wall thickness 134 may be normalized. As used herein, a normalized value is the actual value of a particular wall thickness divided by the actual value of the trailing edge wall thickness 134 at fifty percent of the airfoil span 110. For example, assume that the pressure side wall portion thickness 128 at seventy percent of the airfoil span 110 is 0.25 inches and the trailing edge wall thickness 134 at fifty percent of the airfoil span 110 is 0.75 inches. In this case, the normalized pressure side wall portion thickness at seventy percent of the airfoil span 110 is 0.25 inches divided by 0.75 inches, which is 0.333.

Table I shows one embodiment of the values of a normalized pressure side wall portion thickness NPSWPT, a normalized suction side wall portion thickness NSSWPT, a normalized leading edge wall thickness NLEWT, and a normalized trailing edge wall thickness NTEWT from zero percent of the airfoil span 110 to one hundred percent of the airfoil span 110 in increments of ten percent (i.e., at zero percent, ten percent, twenty percent, thirty percent, forty percent, fifty percent, sixty percent, seventy percent, eighty percent, ninety percent, and one hundred percent). Table II and Table III show alternate embodiments of these values. The embodiments of the values shown in Tables I and II are a range of values for each normalized thickness (i.e., a lower limit and an upper limit), while the embodiment of the values in Table III is a single value.

The Table I, Table II, and Table III values are generated and shown to three decimal places for determining the thickness profile of the airfoil wall 140. There are typical manufacturing tolerances as well as coatings that must be accounted for in the profile of the airfoil wall 140. It will therefore be appreciated that typical manufacturing tolerances (i.e., ±values), including any coating thicknesses, are additive to the values in the Tables I, II, and III below.

TABLE I

| Airfoil Span [%] | NLEWT Upper Limit | NLEWT Lower Limit | NPSWPT Upper Limit | NPSWPT Lower Limit |
|---|---|---|---|---|
| 100 | 0.121 | 0.071 | 0.115 | 0.065 |
| 90 | 0.134 | 0.084 | 0.116 | 0.066 |
| 80 | 0.149 | 0.099 | 0.120 | 0.070 |
| 70 | 0.154 | 0.104 | 0.125 | 0.075 |
| 60 | 0.151 | 0.101 | 0.127 | 0.077 |
| 50 | 0.143 | 0.093 | 0.142 | 0.092 |
| 40 | 0.150 | 0.100 | 0.153 | 0.103 |
| 30 | 0.176 | 0.126 | 0.164 | 0.114 |
| 20 | 0.204 | 0.154 | 0.182 | 0.132 |
| 10 | 0.229 | 0.179 | 0.209 | 0.159 |
| 0 | 0.247 | 0.197 | 0.229 | 0.179 |

| Airfoil Span [%] | NSSWPT Upper Limit | NSSWPT Lower Limit | NTEWT Upper Limit | NTEWT Lower Limit |
|---|---|---|---|---|
| 100 | 0.124 | 0.074 | 1.033 | 0.983 |
| 90 | 0.122 | 0.072 | 1.026 | 0.976 |
| 80 | 0.121 | 0.071 | 1.033 | 0.983 |
| 70 | 0.126 | 0.076 | 1.027 | 0.977 |
| 60 | 0.129 | 0.079 | 1.020 | 0.970 |
| 50 | 0.137 | 0.087 | 1.025 | 0.975 |
| 40 | 0.151 | 0.101 | 1.021 | 0.971 |
| 30 | 0.161 | 0.111 | 1.011 | 0.961 |
| 20 | 0.178 | 0.128 | 0.976 | 0.926 |
| 10 | 0.208 | 0.158 | 0.936 | 0.886 |
| 0 | 0.237 | 0.187 | 0.891 | 0.841 |

TABLE II

| Airfoil Span [%] | NLEWT Upper Limit | NLEWT Lower Limit | NPSWPT Upper Limit | NPSWPT Lower Limit |
|---|---|---|---|---|
| 100 | 0.106 | 0.086 | 0.100 | 0.080 |
| 90 | 0.119 | 0.099 | 0.101 | 0.081 |
| 80 | 0.134 | 0.114 | 0.105 | 0.085 |
| 70 | 0.139 | 0.119 | 0.110 | 0.090 |
| 60 | 0.136 | 0.116 | 0.112 | 0.092 |
| 50 | 0.128 | 0.108 | 0.127 | 0.107 |
| 40 | 0.135 | 0.115 | 0.138 | 0.118 |
| 30 | 0.161 | 0.141 | 0.149 | 0.129 |
| 20 | 0.189 | 0.169 | 0.167 | 0.147 |
| 10 | 0.214 | 0.194 | 0.194 | 0.174 |
| 0 | 0.232 | 0.212 | 0.214 | 0.194 |

| Airfoil Span [%] | NSSWPT Upper Limit | NSSWPT Lower Limit | NTEWT Upper Limit | NTEWT Lower Limit |
|---|---|---|---|---|
| 100 | 0.109 | 0.089 | 1.018 | 0.998 |
| 90 | 0.107 | 0.087 | 1.011 | 0.991 |
| 80 | 0.106 | 0.086 | 1.018 | 0.998 |
| 70 | 0.111 | 0.091 | 1.012 | 0.992 |
| 60 | 0.114 | 0.094 | 1.005 | 0.985 |
| 50 | 0.122 | 0.102 | 1.010 | 0.990 |
| 40 | 0.136 | 0.116 | 1.006 | 0.986 |
| 30 | 0.146 | 0.126 | 0.996 | 0.976 |
| 20 | 0.163 | 0.143 | 0.961 | 0.941 |
| 10 | 0.193 | 0.173 | 0.921 | 0.901 |
| 0 | 0.222 | 0.202 | 0.876 | 0.856 |

TABLE III

| Airfoil Span [%] | NLEWT | NPSWPT | NSSWPT | NTEWT |
|---|---|---|---|---|
| 100 | 0.096 | 0.090 | 0.099 | 1.008 |
| 90 | 0.109 | 0.091 | 0.097 | 1.001 |
| 80 | 0.124 | 0.095 | 0.096 | 1.008 |
| 70 | 0.129 | 0.100 | 0.101 | 1.002 |
| 60 | 0.126 | 0.102 | 0.104 | 0.995 |
| 50 | 0.118 | 0.117 | 0.112 | 1.000 |
| 40 | 0.125 | 0.128 | 0.126 | 0.996 |
| 30 | 0.151 | 0.139 | 0.136 | 0.986 |
| 20 | 0.179 | 0.157 | 0.153 | 0.951 |
| 10 | 0.204 | 0.184 | 0.183 | 0.911 |
| 0 | 0.222 | 0.204 | 0.212 | 0.866 |

The values for the normalized pressure side wall portion thickness NPSWPT, the normalized suction side wall portion thickness NSSWPT, the normalized leading edge wall thickness NLEWT, and the normalized trailing edge wall thickness NTEWT define the pressure side wall portion thickness 128, the suction side wall portion thickness 130, the leading edge wall thickness 132, and the trailing edge wall thickness 134, which improve heat transfer, flow distribution, and mechanical load transfer over conventional airfoils.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal language of the claims.

What is claimed is:

1. An airfoil for a turbine blade, the airfoil comprising:

a pressure side wall having a normalized pressure side wall thickness;

a suction side wall having a normalized suction side wall thickness, the suction side wall connected to the pressure side wall at a leading edge and a trailing edge, the leading edge having a normalized leading edge thickness and the trailing edge having a normalized trailing edge thickness; and an internal cavity defined by the pressure side wall and the suction side wall;

wherein the airfoil defines a span extending between zero percent of the span at an airfoil root and one hundred percent of span at an airfoil tip, the normalized pressure side wall thickness is a value of the pressure side wall thickness at a given span divided by a value of the pressure side wall thickness at fifty percent of the span, the normalized suction side wall thickness is a value of the suction side wall thickness at a given span divided by a value of the suction side wall thickness at fifty percent of the span, the normalized leading edge thickness is a value of the leading edge thickness at a given span divided by a value of the leading edge thickness at fifty percent of the span, and the normalized trailing edge thickness is a value of the trailing edge thickness at a given span divided by a value of the trailing edge thickness at fifty percent of the span;

wherein the normalized pressure side wall thickness suction side wall is between 0.194 and 0.214 at zero percent of the span, between 0.107 and 0.127 at fifty percent of the span, and between 0.080 and 0.100 at one hundred percent of the span;

wherein the normalized suction side wall thickness is between 0.202 and 0.222 at zero percent of the span, between 0.102 and 0.122 at fifty percent of the span, and between 0.089 and 0.109 at one hundred percent of the span;

wherein the normalized leading edge thickness is between 0.212 and 0.232 at zero percent of the span, between 0.108 and 0.128 at fifty percent of the span, and between 0.086 and 0.106 at one hundred percent of the span; and wherein the normalized trailing edge thickness is between 0.856 and 0.876 at zero percent of the span, between 0.900 and 1.100 at fifty percent of the span, and between 0.998 and 1.018 at one hundred percent of the span.

2. The airfoil of claim 1, wherein the normalized pressure side wall thickness is between 0.174 and 0.194 at ten percent of the span, the normalized suction side wall thickness is between 0.173 and 0.193 at ten percent of the span, the normalized leading edge wall thickness is between 0.194 and 0.204 at ten percent of the span, and the normalized trailing edge wall thickness is between 0.901 and 0.921 at ten percent of the span.

3. The airfoil of claim 1, wherein the normalized pressure side wall thickness is between 0.147 and 0.167 at twenty percent of the span, the normalized suction side wall thickness is between 0.143 and 0.163 at twenty percent of the span, the normalized leading edge wall thickness is between 0.169 and 0.189 at twenty percent of the span, and the normalized trailing edge wall thickness is between 0.941 and 0.961 at twenty percent of the span.

4. The airfoil of claim 1, wherein the normalized pressure side wall thickness is between 0.129 and 0.149 at thirty percent of the span, the normalized suction side wall thickness is between 0.126 and 0.146 at thirty percent of the span, the normalized leading edge wall thickness is between 0.141 and 0.161 at thirty percent of the span, and the normalized trailing edge wall thickness is between 0.976 and 0.996 at thirty percent of the span.

5. The airfoil of claim 1, wherein the normalized pressure side wall thickness is between 0.118 and 0.138 at forty percent of the span, the normalized suction side wall thickness is between 0.116 and 0.136 at forty percent of the span, the normalized leading edge wall thickness is between 0.115 and 0.135 at forty percent of the span, and the normalized trailing edge wall thickness is between 0.986 and 1.006 at forty percent of the span.

6. The airfoil of claim 1, wherein the normalized pressure side wall thickness is between 0.092 and 0.112 at sixty percent of the span, the normalized suction side wall thickness is between 0.094 and 0.114 at sixty percent of the span, the normalized leading edge wall thickness is between 0.116 and 0.136 at sixty percent of the span, and the normalized trailing edge wall thickness is between 0.985 and 1.005 at sixty percent of the span.

7. The airfoil of claim 1, wherein the normalized pressure side wall thickness is between 0.090 and 0.110 at seventy percent of the span, the normalized suction side wall thickness is between 0.091 and 0.111 at seventy percent of the span, the normalized leading edge wall thickness is between 0.119 and 0.139 at seventy percent of the span, and the normalized trailing edge wall thickness is between 0.992 and 1.012 at seventy percent of the span.

8. The airfoil of claim 1, wherein the normalized pressure side wall thickness is between 0.085 and 0.105 at eighty percent of the span, the normalized suction side wall thickness is between 0.086 and 0.106 at eighty percent of the span, the normalized leading edge wall thickness is between 0.114 and 0.134 at eighty percent of the span, and the normalized trailing edge wall thickness is between 0.998 and 1.018 at eighty percent of the span.

9. The airfoil of claim 1, wherein the normalized pressure side wall thickness is between 0.081 and 0.101 at ninety percent of the span, the normalized suction side wall thickness is between 0.087 and 0.107 at ninety percent of the span, the normalized leading edge wall thickness is between 0.099 and 0.119 at ninety percent of the span, and the normalized trailing edge wall thickness is between 0.991 and 1.011 at ninety percent of the span.

10. The airfoil of claim 1, wherein the normalized pressure side wall thickness suction side wall is between 0.174 and 0.194 at ten percent of the span, between 0.147 and 0.167 at twenty percent of the span, between 0.129 and 0.149 at thirty percent of the span, between 0.118 and 0.138 at forty percent of the span, between 0.092 and 0.112 at sixty percent of the span, between 0.090 and 0.110 at seventy percent of the span, between 0.085 and 0.105 at eighty percent of the span, and between 0.081 and 0.101 at ninety percent of the span;

wherein the normalized suction side wall thickness is between 0.173 and 0.193 at ten percent of the span, between 0.143 and 0.163 at twenty percent of the span, between 0.126 and 0.146 at thirty percent of the span, between 0.116 and 0.136 at forty percent of the span, between 0.094 and 0.114 at sixty percent of the span, between 0.091 and 0.111 at seventy percent of the span, between 0.086 and 0.106 at eighty percent of the span, and between 0.087 and 0.107 at ninety percent of the span;

wherein the normalized leading edge thickness is between 0.194 and 0.214 at ten percent of the span, between 0.169 and 0.189 at twenty percent of the span, between 0.141 and 0.161 at thirty percent of the span, between 0.115 and 0.135 at forty percent of the span, between 0.116 and 0.136 at sixty percent of the span, between 0.119 and 0.139 at seventy percent of the span, between 0.114 and 0.134 at eighty percent of the span, and between 0.099 and 0.119 at ninety percent of the span; and wherein the normalized trailing edge thickness is between 0.901 and 0.921 at ten percent of the span, between 0.941 and 0.961 at twenty percent of the span, between 0.976 and 0.996 at thirty percent of the span, between 0.986 and 1.006 at forty percent of the span, between 0.985 and 1.005 at sixty percent of the span, between 0.992 and 1.012 at seventy percent of the span, between 0.998 and 1.018 at eighty percent of the span, and between 0.991 and 1.011 at ninety percent of the span.

11. A gas turbine, comprising:

a compressor section;

a combustion section; and a turbine section, comprising:

a plurality of turbine blades, each of the plurality of turbine blades comprising an airfoil, the airfoil comprising:

a pressure side wall having a normalized pressure side wall thickness;

a suction side wall having a normalized suction side wall thickness, the suction side wall connected to the pressure side wall at a leading edge and a trailing edge, the leading edge having a normalized leading edge thickness and the trailing edge having a normalized trailing edge thickness; and an internal cavity defined by the pressure side wall and the suction side wall;

wherein the airfoil defines a span extending between zero percent of the span at an airfoil root and one hundred percent of span at an airfoil tip, the normalized pressure side wall thickness is a value of the pressure side wall thickness at a given span divided by a value of the pressure side wall thickness at fifty percent of the span, the normalized suction side wall thickness is a value of the suction side wall thickness at a given span divided by a value of the suction side wall thickness at fifty percent of the span, the normalized leading edge thickness is a value of the leading edge thickness at a given span divided by a value of the leading edge thickness at fifty percent of the span, and the normalized trailing edge thickness is a value of the trailing edge thickness at a given span divided by a value of the trailing edge thickness at fifty percent of the span;

wherein the normalized pressure side wall thickness suction side wall is between 0.194 and 0.214 at zero percent of the span, between 0.107 and 0.127 at fifty percent of the span, and between 0.080 and 0.100 at one hundred percent of the span;

wherein the normalized suction side wall thickness is between 0.202 and 0.222 at zero percent of the span, between 0.102 and 0.122 at fifty percent of the span, and between 0.089 and 0.109 at one hundred percent of the span;

wherein the normalized leading edge thickness is between 0.212 and 0.232 at zero percent of the span, between 0.108 and 0.128 at fifty percent of the span, and between 0.086 and 0.106 at one hundred percent of the span; and wherein the normalized trailing edge thickness is between 0.856 and 0.876 at zero percent of the span, between 0.900 and 1.100 at fifty percent of the span, and between 0.998 and 1.018 at one hundred percent of the span.

12. The gas turbine of claim 11, wherein the normalized pressure side wall thickness is between 0.174 and 0.194 at ten percent of the span, the normalized suction side wall thickness is between 0.173 and 0.193 at ten percent of the span, the normalized leading edge wall thickness is between 0.194 and 0.204 at ten percent of the span, and the normalized trailing edge wall thickness is between 0.901 and 0.921 at ten percent of the span.

13. The gas turbine of claim 11, wherein the normalized pressure side wall thickness is between 0.147 and 0.167 at twenty percent of the span, the normalized suction side wall thickness is between 0.143 and 0.163 at twenty percent of the span, the normalized leading edge wall thickness is between 0.169 and 0.189 at twenty percent of the span, and the normalized trailing edge wall thickness is between 0.941 and 0.961 at twenty percent of the span.

14. The gas turbine of claim 11, wherein the normalized pressure side wall thickness is between 0.129 and 0.149 at thirty percent of the span, the normalized suction side wall thickness is between 0.126 and 0.146 at thirty percent of the span, the normalized leading edge wall thickness is between 0.141 and 0.161 at thirty percent of the span, and the normalized trailing edge wall thickness is between 0.976 and 0.996 at thirty percent of the span.

15. The gas turbine of claim 11, wherein the normalized pressure side wall thickness is between 0.118 and 0.138 at forty percent of the span, the normalized suction side wall thickness is between 0.116 and 0.136 at forty percent of the span, the normalized leading edge wall thickness is between 0.115 and 0.135 at forty percent of the span, and the normalized trailing edge wall thickness is between 0.986 and 1.006 at forty percent of the span.

16. The gas turbine of claim 11, wherein the normalized pressure side wall thickness is between 0.092 and 0.112 at sixty percent of the span, the normalized suction side wall thickness is between 0.094 and 0.114 at sixty percent of the span, the normalized leading edge wall thickness is between 0.116 and 0.136 at sixty percent of the span, and the normalized trailing edge wall thickness is between 0.985 and 1.005 at sixty percent of the span.

17. The gas turbine of claim 11, wherein the normalized pressure side wall thickness is between 0.090 and 0.110 at seventy percent of the span, the normalized suction side wall thickness is between 0.091 and 0.111 at seventy percent of the span, the normalized leading edge wall thickness is between 0.119 and 0.139 at seventy percent of the span, and the normalized trailing edge wall thickness is between 0.992 and 1.012 at seventy percent of the span.

18. The gas turbine of claim 11, wherein the normalized pressure side wall thickness is between 0.085 and 0.105 at eighty percent of the span, the normalized suction side wall thickness is between 0.086 and 0.106 at eighty percent of the span, the normalized leading edge wall thickness is between 0.114 and 0.134 at eighty percent of the span, and the normalized trailing edge wall thickness is between 0.998 and 1.018 at eighty percent of the span.

19. The gas turbine of claim 11, wherein the normalized pressure side wall thickness is between 0.081 and 0.101 at ninety percent of the span, the normalized suction side wall thickness is between 0.087 and 0.107 at ninety percent of the span, the normalized leading edge wall thickness is between 0.099 and 0.119 at ninety percent of the span, and the normalized trailing edge wall thickness is between 0.991 and 1.011 at ninety percent of the span.

20. The gas turbine of claim 11, wherein the normalized pressure side wall thickness suction side wall is between 0.174 and 0.194 at ten percent of the span, between 0.147 and 0.167 at twenty percent of the span, between 0.129 and 0.149 at thirty percent of the span, between 0.118 and 0.138 at forty percent of the span, between 0.092 and 0.112 at sixty percent of the span, between 0.090 and 0.110 at seventy percent of the span, between 0.085 and 0.105 at eighty percent of the span, and between 0.081 and 0.101 at ninety percent of the span;

wherein the normalized suction side wall thickness is between 0.173 and 0.193 at ten percent of the span, between 0.143 and 0.163 at twenty percent of the span, between 0.126 and 0.146 at thirty percent of the span, between 0.116 and 0.136 at forty percent of the span, between 0.094 and 0.114 at sixty percent of the span, between 0.091 and 0.111 at seventy percent of the span, between 0.086 and 0.106 at eighty percent of the span, and between 0.087 and 0.107 at ninety percent of the span;

wherein the normalized leading edge thickness is between 0.194 and 0.214 at ten percent of the span, between 0.169 and 0.189 at twenty percent of the span, between 0.141 and 0.161 at thirty percent of the span, between 0.115 and 0.135 at forty percent of the span, between 0.116 and 0.136 at sixty percent of the span, between 0.119 and 0.139 at seventy percent of the span, between 0.114 and 0.134 at eighty percent of the span, and between 0.099 and 0.119 at ninety percent of the span; and wherein the normalized trailing edge thickness is between 0.901 and 0.921 at ten percent of the span, between 0.941 and 0.961 at twenty percent of the span, between 0.976 and 0.996 at thirty percent of the span, between 0.986 and 1.006 at forty percent of the span, between 0.985 and 1.005 at sixty percent of the span, between 0.992 and 1.012 at seventy percent of the span, between 0.998 and 1.018 at eighty percent of the span, and between 0.991 and 1.011 at ninety percent of the span.

* * * * *